US006491107B2

(12) United States Patent
Dearing et al.

(10) Patent No.: US 6,491,107 B2
(45) Date of Patent: Dec. 10, 2002

(54) METHOD AND APPARATUS FOR RUNNING SPOOLED TUBING INTO A WELL

(75) Inventors: Michael P. Dearing, Cypress, TX (US); Jerry W. Noles, Sr., Stigler, OK (US); Daniel R. King, Houston, TX (US)

(73) Assignee: Rolligon Corporation, Anderson, TX (US)

( * ) Notice: Subject to any disclaimer, the term of this patent is extended or adjusted under 35 U.S.C. 154(b) by 28 days.

(21) Appl. No.: 09/727,168

(22) Filed: Nov. 29, 2000

(65) Prior Publication Data

US 2002/0125014 A1 Sep. 12, 2002

(51) Int. Cl.[7] ..... E21B 19/22
(52) U.S. Cl. ..... 166/381; 166/384; 166/77.2
(58) Field of Search ..... 166/381, 372, 166/370, 384, 385, 77.1, 77.2, 77.51, 85.5

(56) References Cited

U.S. PATENT DOCUMENTS

| | | | | |
|---|---|---|---|---|
| 3,260,308 A | | 7/1966 | Cryer | |
| 3,971,437 A | | 7/1976 | Clay | |
| 4,527,633 A | | 7/1985 | McLaughlin | |
| 4,585,066 A | | 4/1986 | Moore | |
| 4,673,035 A | | 6/1987 | Gipson | |
| 4,681,169 A | | 7/1987 | Brookbank | |
| 5,161,956 A | | 11/1992 | Fiedler | |
| 5,180,014 A | | 1/1993 | Cox | |
| 5,183,391 A | | 2/1993 | Fiedler | |
| 5,211,242 A | | 5/1993 | Coleman | |
| 5,553,668 A | * | 9/1996 | Council et al. | 166/77.3 |
| 5,599,004 A | * | 2/1997 | Newman et al. | 254/134.3 FT |
| 5,611,671 A | | 3/1997 | Tripp, Jr. | |
| 5,839,514 A | * | 11/1998 | Gipson | 166/384 |
| 5,860,483 A | * | 1/1999 | Havig | 175/40 |
| 6,209,634 B1 | * | 4/2001 | Avakov et al. | 166/77.3 |
| 6,276,454 B1 | * | 8/2001 | Fontana et al. | 166/343 |

* cited by examiner

*Primary Examiner*—Frank S. Tsay
(74) *Attorney, Agent, or Firm*—G. Turner Moller

(57) ABSTRACT

A pair of spooled tubing strings are simultaneously run into a hydrocarbon well carrying a chamber providing a check valve. The chamber is positioned below a hydrocarbon formation so that liquid produced from the formation falls adjacent and passes into the chamber through the check valve. Periodically, gas is delivered through one of the spooled tubing strings to push liquid out of the chamber upwardly through the other of the tubing strings. Gas produced from the formation flows upwardly in an annulus between the spooled tubing strings and a production string in the well. The apparatus can be used to run only one string of tubing into a well and has a number of features, including measuring the load applied to the tubing string and measuring the amount of tubing run into or out of a well.

26 Claims, 7 Drawing Sheets

METHOD AND APPARATUS FOR RUNNING SPOOLED TUBING INTO A WELL

This invention is a method and apparatus for running spooled tubing into a well, particularly into a hydrocarbon well.

BACKGROUND OF THE INVENTION

There are a number of techniques for artificially lifting formation liquids from hydrocarbon wells. Reciprocating sucker rod pumps are the most common because they are the most cost effective, all things considered, over a wide variety of applications. Other types of artificial lift include electrically driven down hole pumps, hydraulic pumps, gas lift, rotating rod pumps, and free pistons or plunger lifts. These alternate types of artificial lift are more effective, either in cost or efficiency, than sucker rod pumps in the niches or applications where they have become popular.

Gas wells reach their economic limit for a variety of reasons. A very common reason is the produced gas volume declines to a point where it is insufficient to move formation liquids upwardly to the surface. Two phase upward flow in a well is complicated and most equations thought to predict flow are only rough estimates of what is going on. One reason is the changing relation of the liquid and gas flowing upwardly in the well. At times of more-or-less constant flow, the liquid acts as an upwardly moving film on the inside of the flow string while the gas flows in a central path on the inside of the liquid film. The gas flows much faster than the liquid film. When the volume of gas flow slows below some critical value, the liquid runs down the inside of the flow string and accumulates in the bottom of the well.

If sufficient liquid accumulates in the bottom of the well, the well is no longer able to flow because the pressure in the reservoir is insufficient to cause flow against the pressure of the liquid column. The well is said to have loaded up and died. Years ago, gas wells were plugged much quicker than today because it was not economic to artificially lift small quantities of liquid from a gas well. At relatively high gas prices, it is economic to keep old gas wells on production. It has gradually been realized that gas wells have a life cycle that includes an old age segment where a variety of techniques are used to keep liquids flowing upwardly in the well and thereby prevent the well from loading up and dying.

The appropriate technique for keeping old gas wells flowing depends on where the well is in its life cycle. For example, the first technique is to drop soap sticks into the well. The soap dissolves in the formation liquid and some agitation causes the liquid to foam. The well is then turned to the atmosphere and a great deal of foamed liquid is discharged from the production string. Later in its life cycle, when soaping the well has become ineffective, other techniques such as those listed above are used. Another effective technique is running a velocity string of 1" or 1½" tubing inside the production string so the upward velocity of gas moving in the velocity string is sufficient to keep the liquid moving upwardly.

These techniques all have their advantages and disadvantages. Some techniques work reasonably well but only for a short time and then become ineffective. Some techniques are costly and require substantial maintenance. Some techniques require the well to be reworked by pulling the production string from the well and rerunning it.

Disclosures relevant to this invention are found in U.S. Pat. Nos. 3,260,308; 3,971,437; 4,585,066; 4,673,035; 4,681,169; 5,161,956; 5,180,014; 5,183,391; 5,211,242 and 5,611,671.

SUMMARY OF THE INVENTION

In this invention, a pair of tubing strings are simultaneously run into a well for a variety of reasons. One may be to provide a down hole pump of some description, to provide multiple strings for injecting materials into the well and the like.

In a preferred embodiment of this invention, a chamber is run into a well at the end of two strings of spooled tubing, one being a gas supply string and the other being a liquid production string. The spooled tubing strings are run simultaneously into the well at a sufficiently fast rate to land the chamber adjacent the perforations in a relatively short time. The strings are suspended in a landing sub on the well head. The gas supply string is connected to a source of relatively high pressure gas, such as a compressor or high pressure gas system. The liquid production string is connected to conventional production equipment for handling the produced liquid and gas. Typically,. the gas is delivered to a low pressure gas system or to a compressor for delivery to sales.

The chamber is preferably landed below the perforations so there is no liquid buildup above the perforations impeding gas flow to the surface. The system accordingly acts as a downhole gas-liquid separator where gas flows upwardly in the annulus between the production string and the spooled tubing strings and the liquid flows downwardly into the chamber. The chamber includes a check valve allowing flow into the chamber and preventing reverse flow. Gas is delivered down the gas supply string, either periodically or continuously, which pressurizes the chamber and closes the check valve. When gas at sufficient pressure and in sufficient volume is delivered down the gas supply string, the liquid in the chamber is pushed upwardly through the liquid production string and discharges at the surface into the separator. When the supply gas is turned off, the chamber and spooled tubing strings exhaust into the compressor or low pressure gas system which reduces the pressure in the chamber and allows the check valve to open thereby allowing liquid flow into the chamber. The process is repeated as often as necessary or desirable to keep the well flowing at a commercial rate.

Preferably, the only moving part in the well is the check valve in the chamber, which is made of long lived materials so the apparatus of this invention operates for long periods of time without pulling the spooled tubing strings. Because the chamber is preferably located below the perforations, this invention provides a long term solution to keeping gas wells flowing at commercial rates with minimum maintenance. Because the chamber is preferably located below the perforations, this invention provides the least possible restriction against gas flow from the formation and accordingly provides a liquid lift system that operates effectively from the time of installation to the economic limit of the well. In other words, no further capital costs are needed to produce the well to its economic limit and the well's economic limit is prolonged to the greatest extent possible.

It is one object of this invention to provide a technique for producing hydrocarbon wells that are prone to load up and die.

A further object of this invention is to provide a technique for simultaneously running multiple strings of spooled tubing into a well.

Another object of this invention is to provide a technique for simultaneously running multiple strings of spooled tubing and a down hole pump into a well.

These and other objects and advantages of this invention will become more apparent as this description proceeds, reference being made to the accompanying drawings and appended claims.

DETAILED DESCRIPTION

Figure 1:
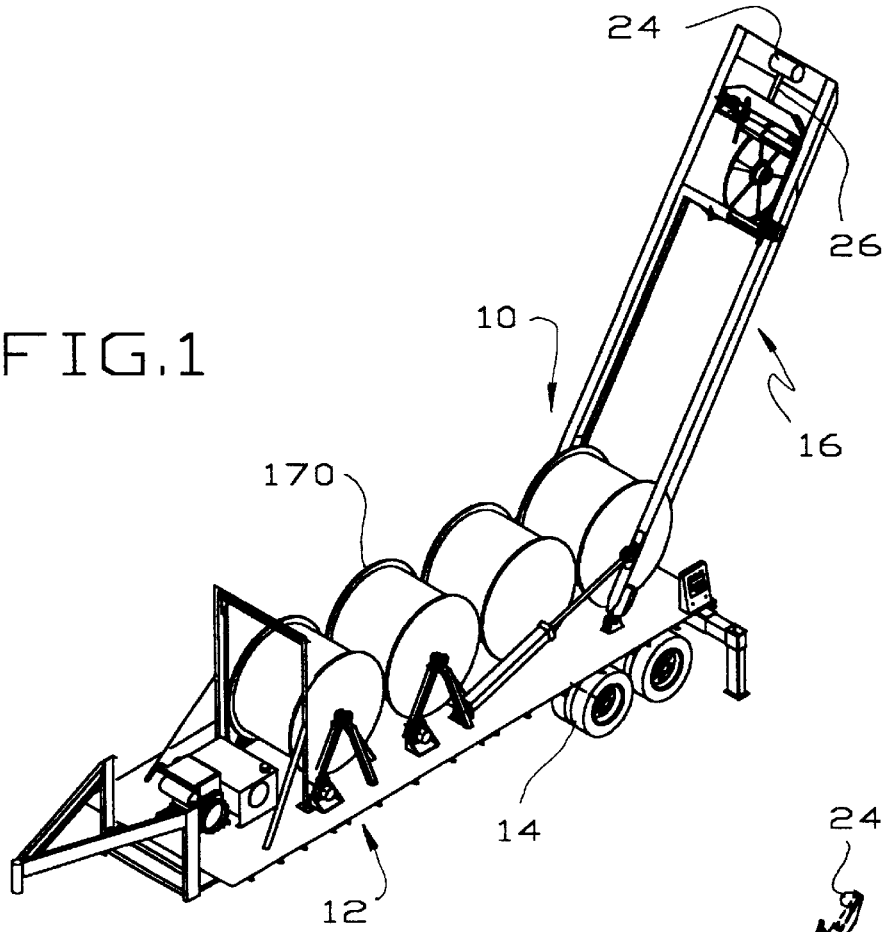
FIG. 1 is an isometric view of a trailer equipped with a system for simultaneously running at least two strings of spooled tubing into a well.
Figure 2:
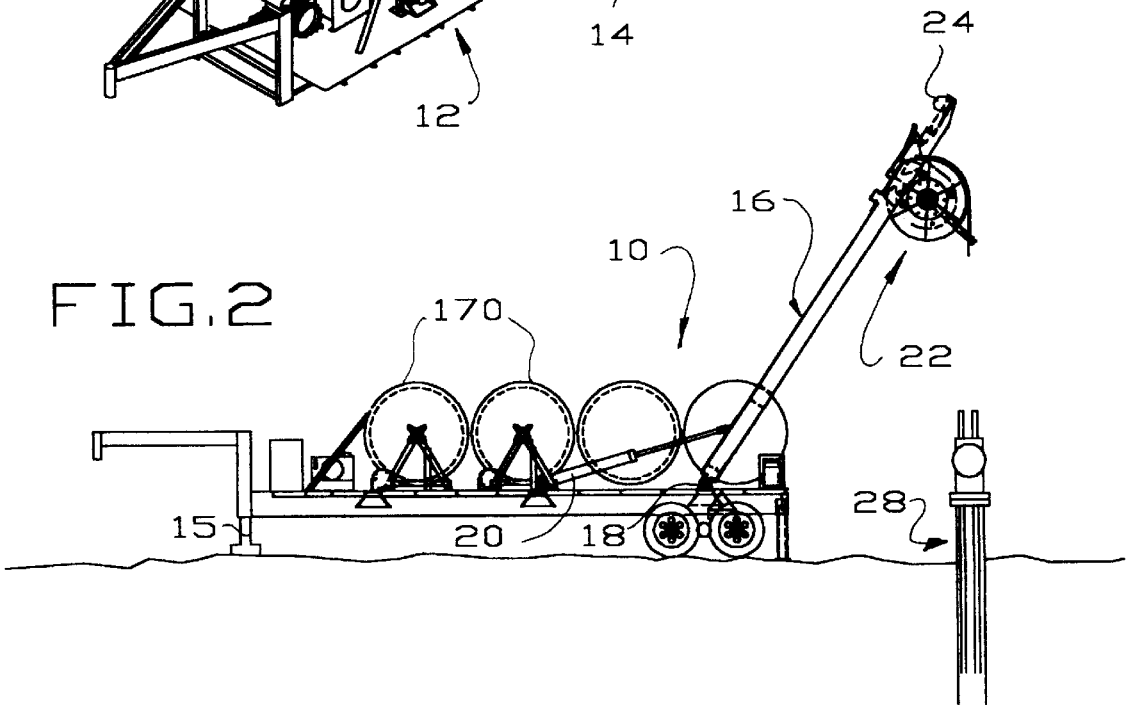
FIG. 2 is a side view of the trailer of FIG. 1.

Referring to FIGS. 1–2, one embodiment of a spooled tubing unit 10 of this invention is mounted on a vehicle 12 such as a truck or trailer having conventional ground engaging wheels 14 and retractable supporting feet 15. A mast 16 is pivotally connected to the trailer 12 by a pin 18 and a hydraulic cylinder 20 moves the mast 16 from a stowed position on top of the trailer 12 to a inclined operative position shown in FIGS. 1–2.

An injector assembly 22 is slidably mounted on the mast 16 for movement toward and away from the free end thereof. To this end, a winch 24 provides a cable 26 connected to the assembly 22 for positioning the assembly at a location immediately above a well 28 into which two or more spooled tubing strings will be simultaneously run. It will be seen that the mast 16 is pivoted to overlie the well 28 and the injector assembly 22 is raised or lowered by the winch 24 so that spooled tubing coming off the injector assembly 22 passes downwardly into the well 28.

In this invention, two or more spooled tubing strings are simultaneously run into the well 28, preferably along with a downhole tool. This has a number of advantages. The most obvious advantage is that running time is reduced by half in the case of two strings, two thirds in the case of three strings, three quarters in the case of four strings and the like. Perhaps more importantly, the connection of the strings to the downhole tool run with them is made at the surface. This is much more reliable than attempting to make a connection at depth inside the well 28 which must be the case if the strings were run separately.

Figure 3:
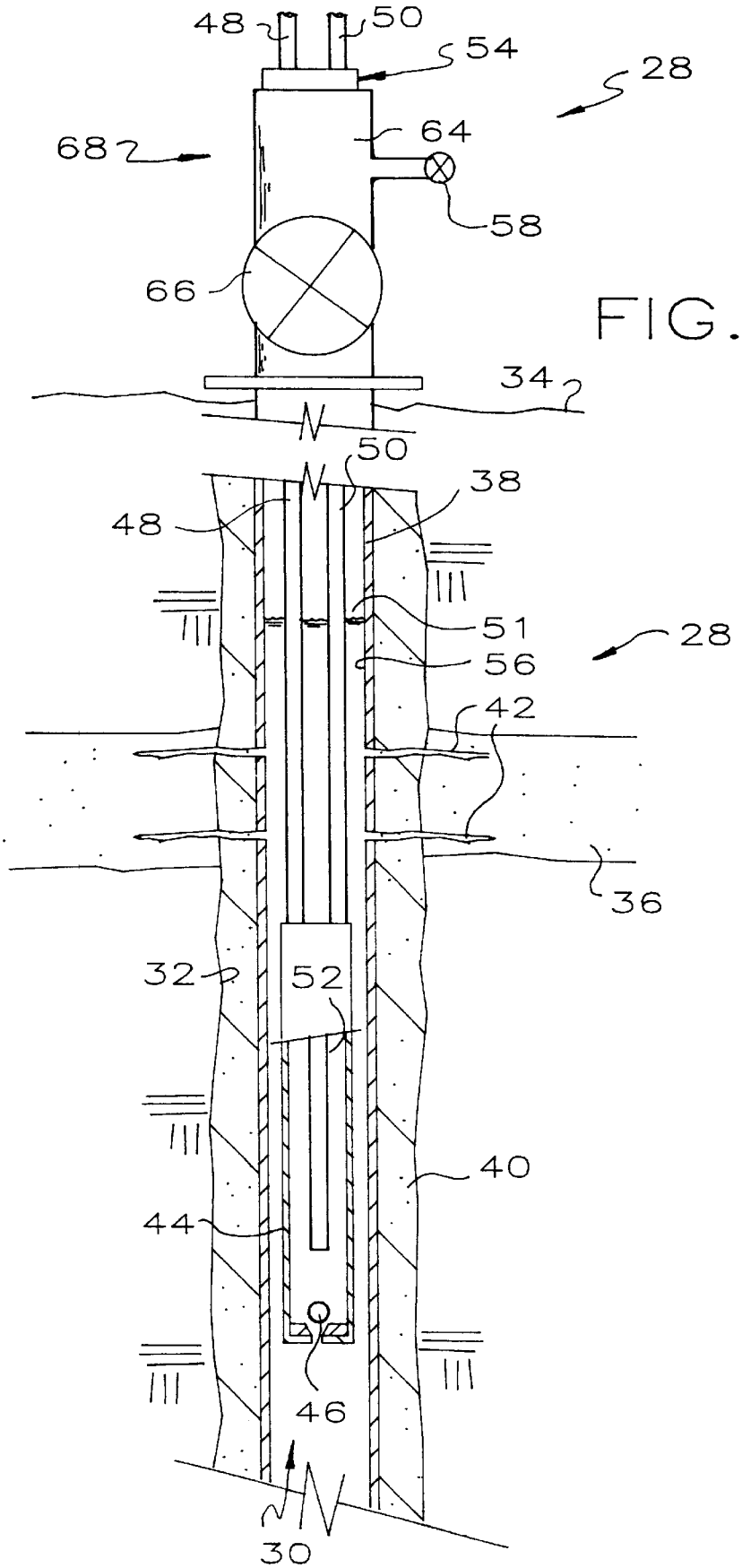
FIG. 3 is a cross-sectional view of a gas well equipped with a liquid lifting device of this invention.

One application of this invention is in running a liquid lifting assembly 30 or other type pump into the well 28. As shown in FIG. 3, the well 28 is of conventional type having a bore hole 32 extending into the earth from the surface 34 through a hydrocarbon formation 36. A production string 38 is cemented in the bore hole 32 with an annular cement sheath 40 and perforations 42 provide communication between the formation 36 and the inside of the production string 38. Those skilled in the art will recognize the well 28 as being a so called tubingless completion where the string 38 cemented in the earth also acts as the conduit for producing formation contents to the surface. As will be apparent, this invention is applicable to any type well configuration.

The assembly 30 comprises an elongate tubular section. or chamber 44 providing a check valve 46 at the lower end thereof allowing liquid to flow into the chamber 44 and preventing flow out of the chamber 44. A spooled tubing string 48 connects to the chamber 32 in any suitable manner, as by threading, crimping, welding or the like and acts as a gas supply string. A spooled tubing string 50 is connected to the chamber 44 in any suitable manner and acts as a liquid delivery string. Preferably, the tubing string 50 may include a stinger 52 extending into the chamber 44. The spooled tubing strings 48, 50 and the chamber 44 are simultaneously run into the well 28 and are landed at a location below a static liquid level 51 in the well. Preferably, the chamber 44 is landed below the perforations 42 for reasons more fully apparent hereinafter. At the surface, the tubing strings 48, 50 are supported by a hanger assembly 54. The gas supply string 48 is connected to a source of high pressure gas such as a compressor or high pressure gas system. The liquid delivery string 50 connects to surface production equipment for separating and treating the products produced from the formation 36.

The chamber 44 is preferably located below the perforations 42 so that any liquid produced from the formation 36 falls by gravity into the rat hole below the producing interval. In this manner, the installation comprises a down hole separator separating natural gas from liquids, the gas being delivered upwardly through the annulus 56 between the production string 38 and the spooled tubing strings 48, 50 and through a wing valve 58 to the surface production equipment. Those skilled in the art will recognize that operation of the liquid lifting device 30 lowers the. water level 51 from a static position supported by the bottom hole pressure in the formation 36 to a lower level. If the liquid level 51 is above the perforations 42, gas bubbles through the liquid column and then passes freely up the annulus 56. 130 High pressure gas is periodically delivered into the gas supply string 48. This pressurizes the chamber 44, closes the check valve 46 and pushes liquid in the chamber 44 upwardly into the liquid delivery string 50 toward the surface. Gas is supplied through the string 48 until a substantial amount of the liquid in the chamber is discharged into production facilities at the surface. At an appropriate time, gas to the supply string 48 is shut off and any gas in the spooled tubing strings 48, 50 and in the chamber 44 bleed off, preferably through a compressor (not shown) for reuse or sale.

In a preferred embodiment of this invention, the only movable component in the well 28 is the check valve 46 which may be made of long lived materials thereby providing a long term solution to production problems of the well 28. In the alternative, a gas lift valve (not shown) may be placed in a mandrel (not shown) in the gas supply string 48 so the string 48 does not have to be bled down during each cycle of operation. Such a gas lift valve is preferably retrievable through the string 48 by wire line as is well known in the art.

Figure 4:
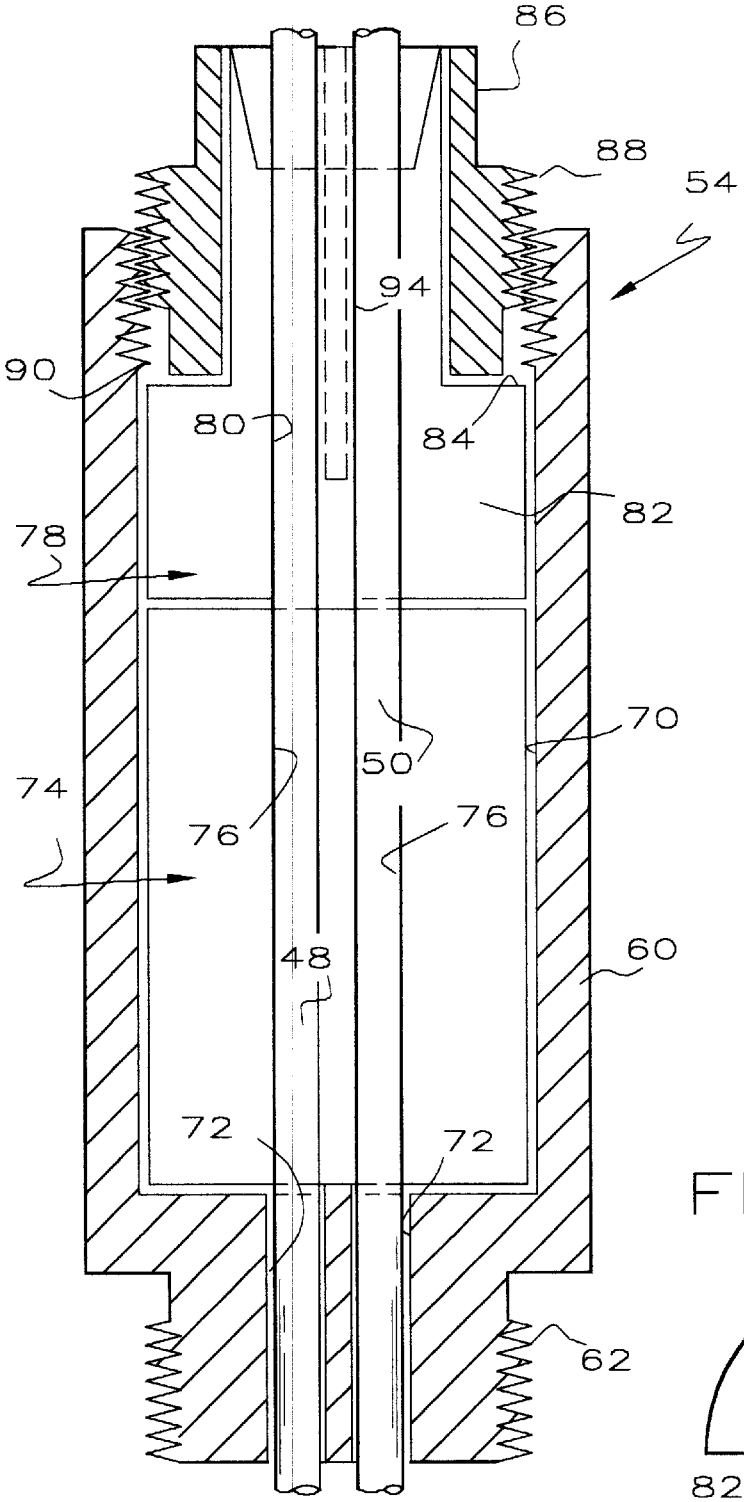
FIG. 4 is a cross-sectional view of a hanger used to support the spooled tubing strings at the surface.
Figure 6:
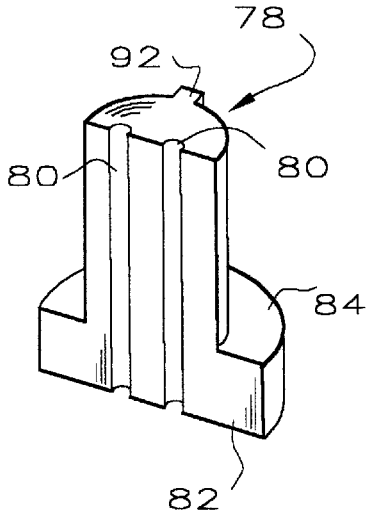
FIG. 6 is an isometric view of another sealing section used in the hanger of FIG. 4.
Figure 5:
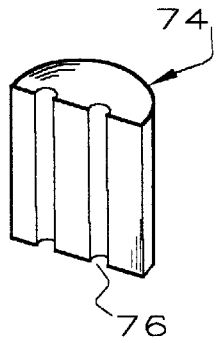
FIG. 5 is an isometric view of a sealing section used in the hanger of FIG. 4.
Figure 7:
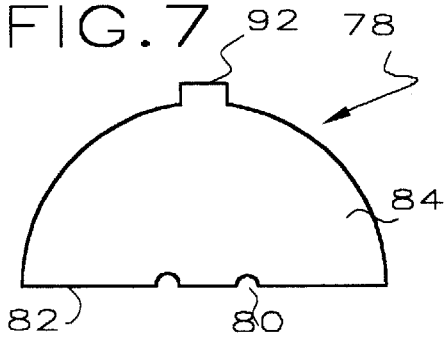
FIG. 7 is a top view of the sealing section of FIG. 6.

Referring to FIGS. 3 and 4, the hanger assembly 54 is shown in greater detail and comprises a body 60 having a pin 62 of a size and thread configuration to be received in a collar or fitting 64 above the master valve 66 of the wellhead 68. The body 60 provides a central cavity 70 communicating through the pin end of the assembly 54 through a pair of passages 72. Inside the cavity 70 is a pair of resilient sealing sections 74 having a pair of elongate linear grooves 76 receiving the spooled tubing strings 48, 50 as shown best in FIGS. 4 and 5. The sealing sections 74 are conveniently made of rubber or other suitable similar resilient material.

Above the first sealing sections 74 are a pair of rigid metallic compression sections 78 having a pair of elongate linear grooves 80 aligned with the grooves 76 for receiving the spooled tubing strings 48, 50. The compression sections 74 provide an enlarged lower portion 82 of the same size as the interior of the cavity 70 providing an upwardly facing shoulder 84 abutting the bottom of a threaded compression nut 86. The nut 86 includes threads 88 meshing with threads 90 on the body 60 for advancing the compression sections 78 and advancing the sections 78 linearly toward and thereby compressing the sealing sections 74. The conduits 48, 50 may act to guide the compression sections 78 linearly toward the sealing sections 74 or a pair of registration ribs 92 may be provided which are received in elongate slots 94 in the cavity 70. In any event, it will be seen that rotating the compression nut 86 in a tightening direction drives the compression sections 78 linearly downwardly thereby compressing the rubber sealing sections 74 against the inside of the cavity 70 and against the outside of the spooled tubing strings 48, 50. This provides a seal against produced formation gas or liquid from passing out the top of the wellhead 68 and thereby directs produced formation products through the wing valve 58 to the surface production equipment.

Referring to FIGS. 8–12, the injector assembly 22 is shown in more detail and comprises a frame 96 having an ear or clevis 98 connected to the cable 26 and a pair of rails 100 guiding the frame 96 for movement along the mast 16. The frame 96 also comprises a pair of beams 102 connected to the rails 100 to provide a rectilinear support for a subframe 104 which slides laterally, or horizontally, relative to the mast 16 under control of a hydraulic cylinder 106.

The subframe 104 comprises a pair of sleeves 108 slidably received on the beams 102 and a plate 110 connected to the sleeves 108. It will be seen that the hydraulic cylinder 106 connects to the frame 96 and to the plate 110 thereby allowing movement of the subframe 104 in the direction shown by the arrow 112. This allows lateral positioning of a wheel 114 relative to the wellhead 68 without moving the trailer 12 or mast 16.

Mounted on the subframe 104, in a manner more fully pointed out hereinafter, is a housing 116 having therein a gearbox 118 driven by a hydraulic motor 120 having an output shaft 122 driving the gearbox 118. The gearbox 118 provides a velocity decrease and a torque increase of the motor 120 and includes a cantilevered output shaft 124 coaxial with the input shaft 122. The output shaft 124 includes a hub 126. The wheel 114 is mounted on the output shaft 124, as by captivating the wheel 114 to the hub 126 with suitable fasteners 128. It will be seen that the wheel 114 is easily removed and replaced by simply unbolting the cap 128, i.e. no outside bearing must be disassembled or the like.

An important feature of the injector assembly 22 is the ability to measure the torque applied to the wheel 114. To this end, the housing 116 is not fixed to the plate 110. Instead, the housing 116 provides a pair of circular flanges or supports 130 which are mounted between a series of rollers 132 supporting the flanges throughout the circumference thereof, i.e. there are at least three and preferably at least four equally spaced rollers 132 supporting the flanges 130. The rollers 132 are mounted on braces 136 extending from the subframe 104. One or more articulated links 138 connects the housing 116 to a load measuring device 140 such as a load cell which measures the load on. the housing 116 or a hydraulic cylinder which records the pressure induced by the load on the housing 116 and thereby measures the load on the housing 116.

Figure 8:
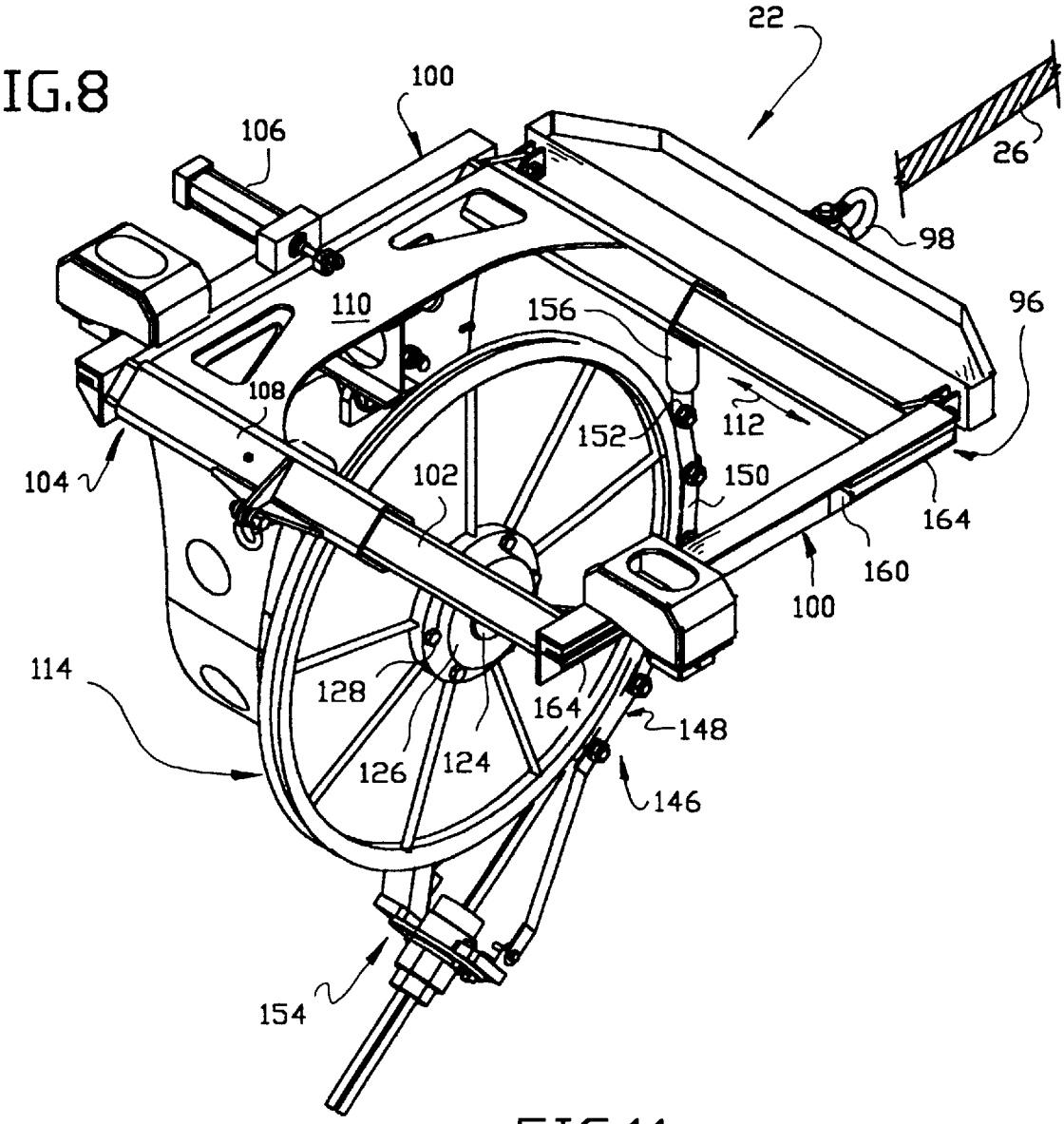
FIG. 8 is an isometric view of the spooled tubing injector of FIG. 1, certain parts being removed for clarity of illustration.
Figure 11:
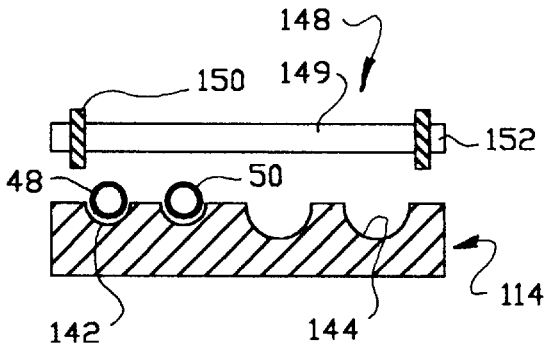
FIG. 11 is an enlarged cross-sectional view of the wheel used to push spooled tubing into a well.
Figure 9:
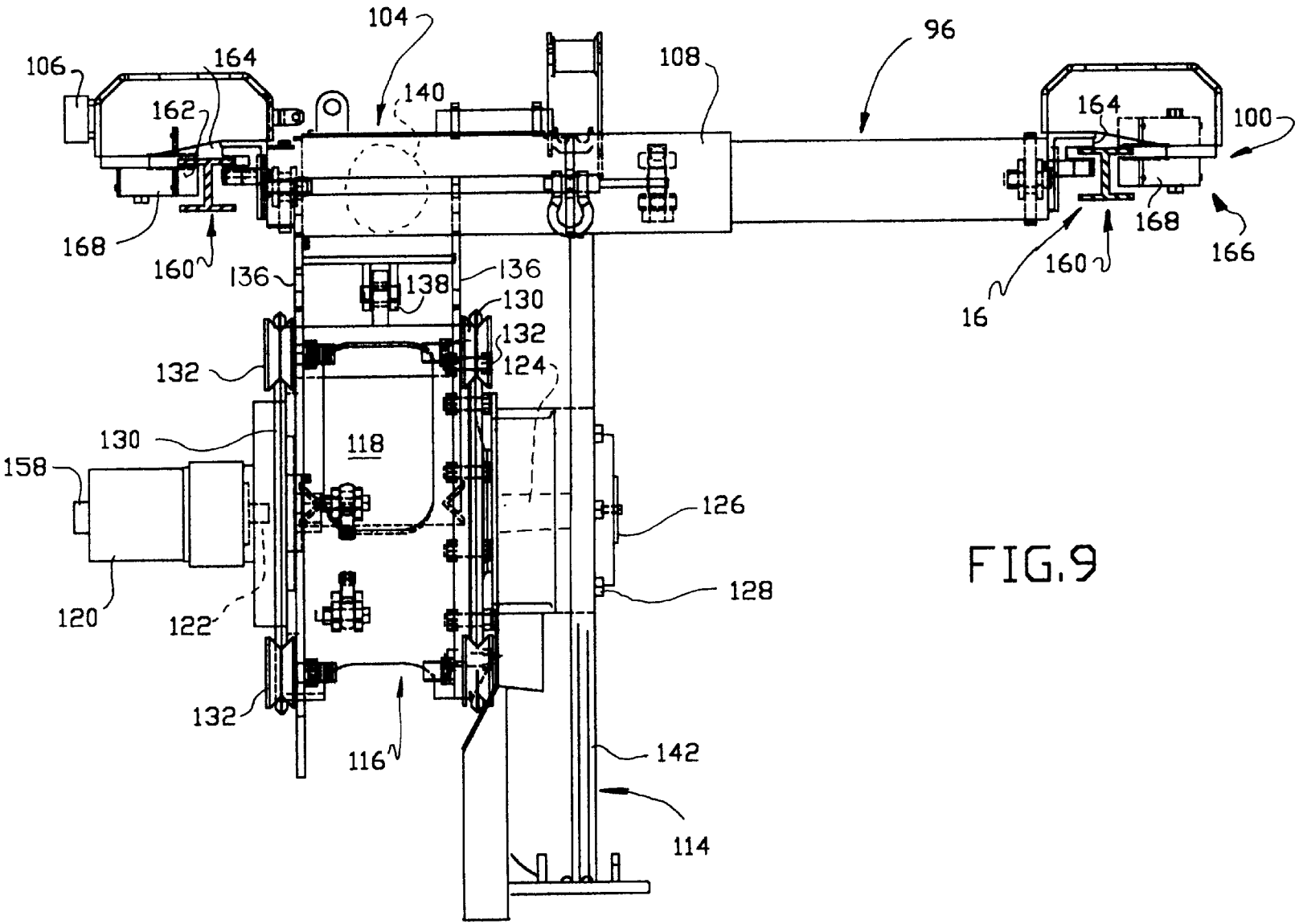
FIG. 9 is a top view of the injector of FIG. 8.
Figure 10:
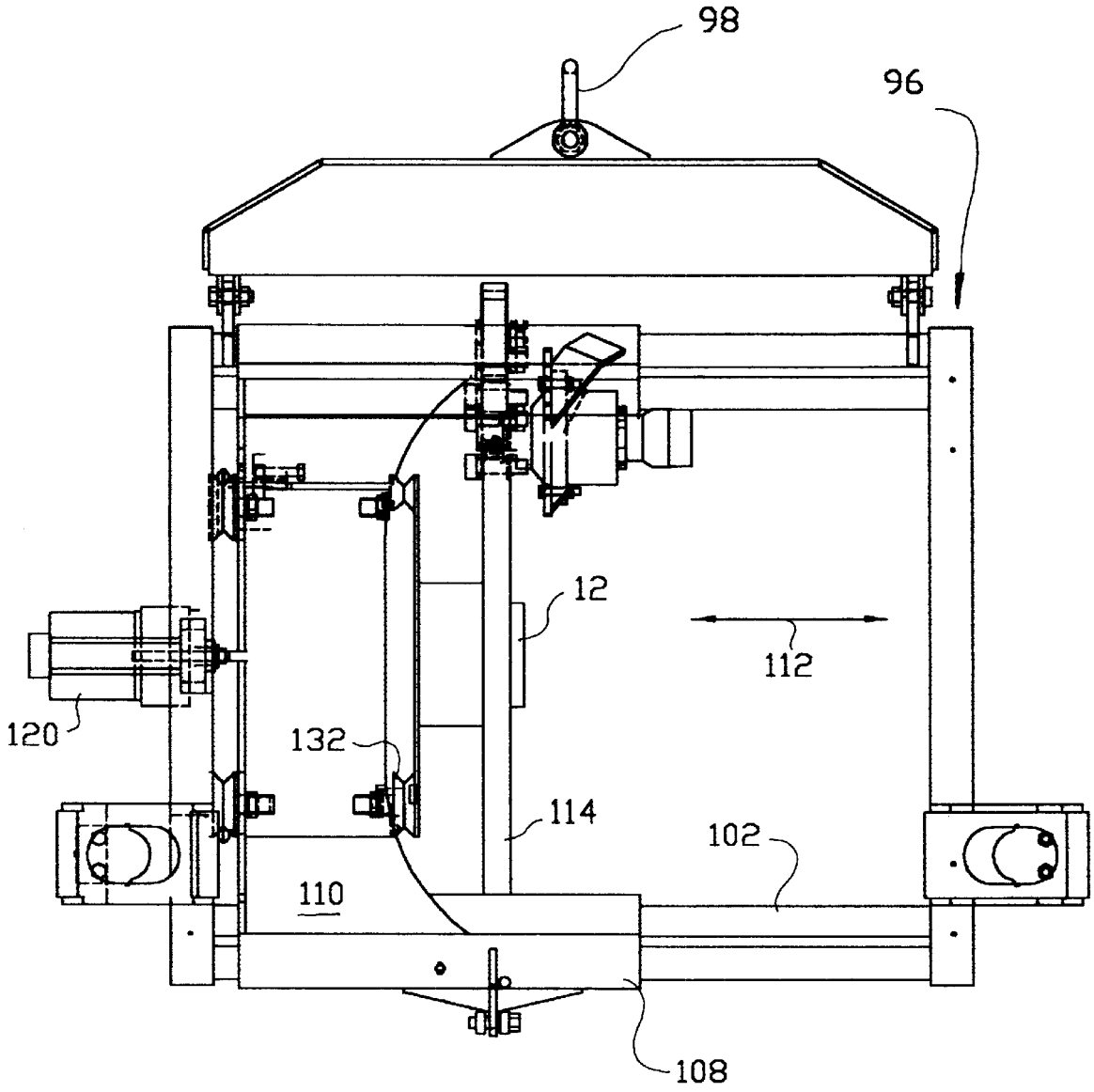
FIG. 10 is an end view of the injector of FIG. 8.

Another important feature of the injector assembly 22 is that the wheel 114 may have a multiplicity of grooves. As shown in FIGS. 8 and 11, the wheel 114 preferably includes first and second grooves 142 of a predetermined size. Typically, the first and second grooves 142 are of the same size and are used to propel spooled tubing strings 48, 50 of the same size into the well 28. In the alternative, the grooves 142 may be of different size. Ideally, the wheel 114 includes additional grooves 144 of a size different than the grooves 142. This allows the spooled tubing unit 10 to run different sized tubing strings into the well 28 without replacing the wheel 114.

Figure 12:
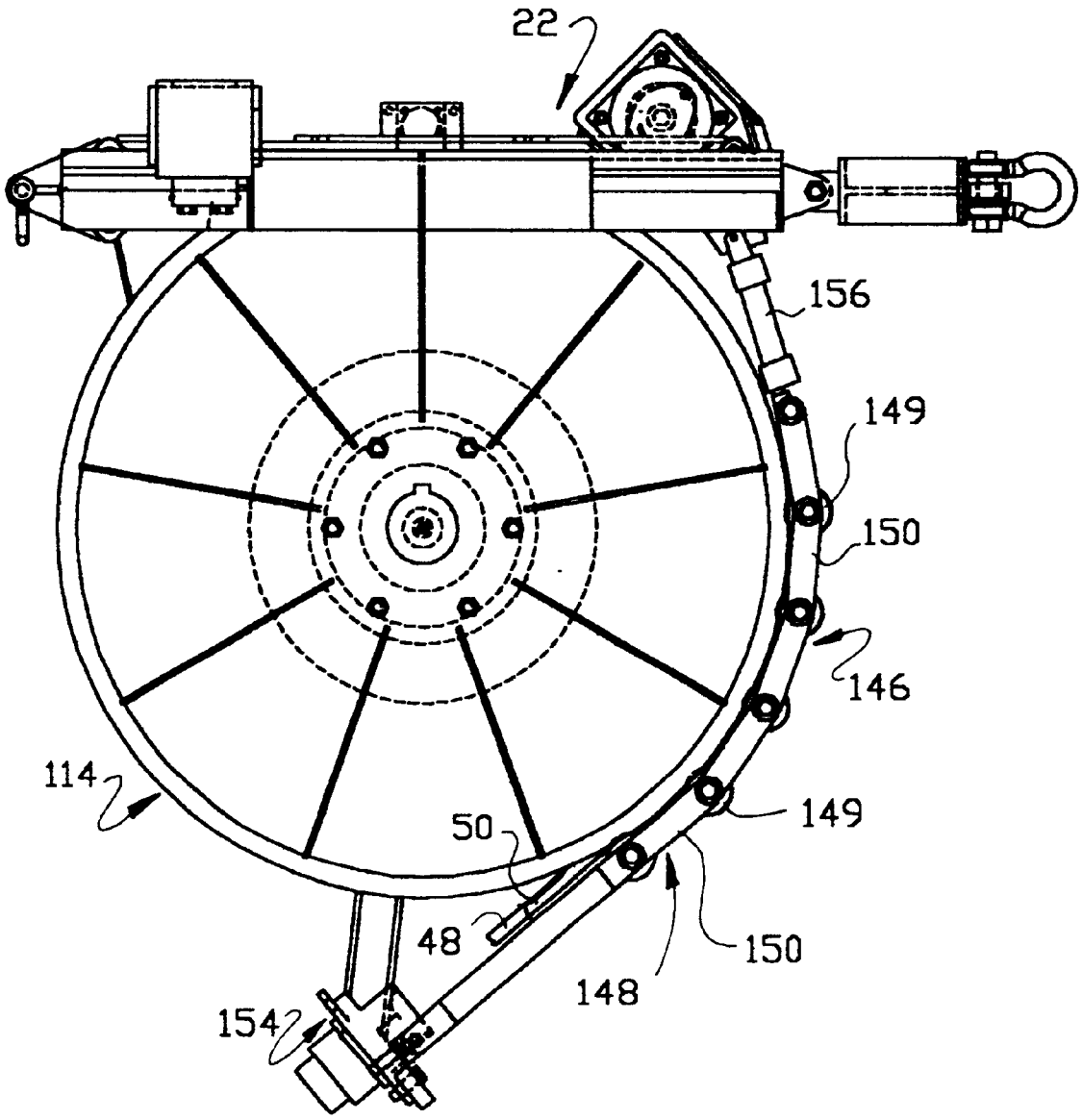
FIG. 12 is a side view of the injector of FIGS. 8–11.

An important feature of the injector assembly 22 is a chain assembly 146 to apply a force to the tubing strings 48, 50 to keep them in the grooves 142 as the tubing strings 48, 50 are being run into the well 28. The chain assembly 146 applies a frictional grip for the wheel 114 to push the tubing strings 48, 50 downwardly toward the well 28. The chain assembly 146 includes a conventional chain 148 having a series of metal rollers 149 connected by links 150 secured by fasteners 152. One end of the chain 148 is fixed to a bracket 154 connected to the frame of the injector assembly 22. The other end of the chain 148 connects to a tensioning device, such as a hydraulic cylinder or motor 156. Retracting the hydraulic motor 156 draws the chain 148 into forcible contact with the tubing strings 48, 50 thereby keeping the tubing strings 48, 50 in the grooves 142, 144 and propelling the tubing strings 48, 50 into the well 28. FIG. 12 is somewhat misleading because it looks like the tubing strings 48, 50 exit in a nearly horizontal direction. It will be recognized, of course, that the assembly 22 is inclined by the position of the mast 16 so the tubing strings 48, 50 exit from the assembly 22 and pass nearly vertically into the well 28. The chain 148 may provide a releasable connection at either end to facilitate threading the tubing strings 48, 50 over the wheel 114 at the start of a tubing running operation.

Another important feature of the injector assembly 22 is the ability to measure the rotation of the wheel 114 and thereby measure the amount of spooled tubing 48, 50 run into the well 28. To this end, a rotational speed sensor 158 is provided to sense the rotational speed of the motor 120. If the speed of the motor 120 is known, the speed of the wheel 114 can be calculated from the known gear reduction provided by the gearbox 118 and the diameter of the wheel 114. The length of the tubing strings 48, 50 run over the wheel 114 can be calculated by multiplying the speed of the wheel 114 by small time increments and then summing the lengths. A display (not shown) is provided at the operator's station on the trailer 12 so the amount of tubing run into the well can be seen by the operator. The display may have an odometer which can be set to zero when the tubing strings 48, 50 are ready to be run into the well 28.

Another important feature of the injector assembly 22 is the ability to apply a braking force between the frame 96 and the mast 16 to lock the injector assembly 22 in place. To this end, the mast 16 provides I or H shaped beams 160 over which the frame 96 slides. As shown best in FIG. 9, a flange 162 of the beams 160 pass through a guide 164 provided by the rails 100, thereby supporting the injector assembly 22 on the mast 16. One or more brake assemblies 166 are provided on the injector assembly 22 and include disc brake caliper pads 168 which are hydraulically forced together to grip the flange 162 and spring loaded toward an open position.

The tubing strings 48, 50 are housed on spools or storage reels 170 mounted on the trailer 12. The spools 170 are mounted for rotation to unspool the tubing strings 48, 50 and suitable motors are provided to rotate the spools 170 and unspool the tubing strings 48, 50 at the same time the tubing strings 48, 50 are driven by the wheel 114 into the well 28.

Operation of the spooled tubing unit 10 of this invention should now be apparent. The trailer 12 is driven to a position where the mast 16 overlies the well 28. The mast 16 is raised and the assembly 22 is moved downwardly along the mast 16 until the outer circumference of the wheel 114 is substantially vertically above the well 28. Chains (not shown) or other suitable means are used to tie the assembly 22 to the well 28. The tubing strings 48, 50 are spooled off the storage reels or spools 170, passed through the appropriate groove 142, 144 in the wheel 114, under the chain assembly 146 and. downwardly toward the well 28. The hanger assembly housing 60 is threaded onto the well head 68, leaving the bushings 74, 78 out but with the compression nut 86 in place.

Any downhole implement, such as the pump 30, is attached to the ends of the tubing strings 48, 50 at a location above ground, i.e. before being run into the well. An important feature of this invention is the ability to make multiple connections above ground rather than having to rely on in-the-well assemblies to make consistently secure connections. The tubing strings 48, 50 are simultaneously run into the well 28 by operating the motor 120. This drives the wheel 114 and the frictional forces between the wheel 114 and the tubing strings 48, 50 propels the tubing strings 48, 50 downwardly into the well 28. Simultaneously with driving the wheel 114, the reels 170 are rotatably driven to propel the tubing strings 48, 50 toward the injector assembly 22.

The amount of tubing being run into the well is known from the display (not shown) at the operator's station. When the reading from the odometer shows the tubing 48, 50 has reached its desired position in the well 28, the motor 120 is stopped. The compression nut 86 of the hanger assembly 54 is removed and the bushings 74, 78 placed in the housing 60. Slips (not shown) are placed onto the outer diameter of the tubing strings 48, 50 and lowered into the top of the hanger assembly 54 until the load of the tubing strings 48, 50 are transferred to the hanger assembly 54. The compression nut 86 is tightened to compress the resilient bushing 78 to seal on the exterior of the tubing strings 48, 50. The tubing strings 48, 50 are connected to suitable surface equipment and controls to begin operation.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

We claim:

1. A method of running at least two strings of spooled tubing into a well comprising providing first and second spools of first and second spooled tubing strings;

simultaneously unwinding the first and second spools and discharging the first and second tubing strings from the spools;

simultaneously driving the first and second tubing strings toward the well; and simultaneously passing the first and second tubing strings downwardly into the well.

2. The method of claim 1 further comprising simultaneously directing the tubing strings from the first and second spools over a rotating wheel having first and second grooves receiving the first and second tubing strings; and gripping the first and second tubing strings in the first and second grooves of the wheel, the step of simultaneously driving the first and second tubing strings comprises simultaneously driving the first and second tubing strings around the wheel.

3. The method of claim 2 wherein the step of simultaneously driving the first and second tubing strings around the wheel comprises driving the wheel.

4. The method of claim 1 further comprising the step of attaching the first and second spooled tubing strings to a downhole implement and then simultaneously running the first and second tubing strings and the downhole implement into the well.

5. A method of working on a well producing hydrocarbons from a formation through perforations in a tubular string comprising simultaneously running at least two strings of spooled tubing into the well to a location adjacent the formation.

6. The method of claim 5 further comprising the step of connecting an implement to the two spooled tubing strings and then running the two spooled tubing strings and the implement into the well.

7. A method of lifting liquid from a well extending into the earth from the surface and intersecting a hydrocarbon bearing formation by intermittently lifting separate volumes of liquid from the well for increasing the flow of hydrocarbons from the formation, comprising simultaneously lowering, into the well, at least a pair of spooled tubing strings having a chamber on the lower ends thereof, the chamber providing a check valve allowing liquid flow into the chamber and preventing liquid flow out of the chamber;

injecting, for a limited time period through a first of the spooled tubing strings, pressurized gas into the chamber thereby pressurizing the chamber and closing the check valve;

lifting, in response to the injected pressurized gas and during the limited time period, liquid in the chamber out of the well through a second of the spooled tubing strings, the first and second tubing strings being located outside each other and in fluid isolation from each other within the well except through the chamber; and producing gaseous hydrocarbons from the formation though the well outside the first and second spooled tubing strings.

8. The method of claim 7 wherein the chamber is lowered into the well to a location below the hydrocarbon formation.

9. The method of claim 7 wherein the well includes a string of pipe cemented in the earth to a depth below the hydrocarbon formation and the well communicates with the formation through a series of perforations, the chamber being lowered into the well to a location below the perforations.

10. Apparatus for simultaneously running at least two strings of spooled tubing into a well, comprising an assembly for receiving at least a pair of spools having thereon first and second strings of spooled tubing; and an assembly for frictionally gripping the first and second spooled tubing strings and propelling the same downwardly toward the well including a wheel having a first circumferential groove for receiving the first spooled tubing string and a second circumferential groove for receiving the second spooled tubing string and an assembly for rotatably driving the wheel in a tubing advancing direction whereby rotation of the wheel simultaneously propels the first and second spooled tubing strings toward the well.

11. The apparatus of claim 10 wherein the first and second grooves are of a predetermined size and further comprising third and fourth grooves of a different predetermined size whereby a first pair of spooled tubing strings of a predetermined size may be run in a well and then a second pair of spooled tubing strings of a different predetermined size may be run in a well without replacing the wheel.

12. The apparatus of claim 10 wherein the assembly for rotatably driving the wheel comprises a motor, a gearbox driven by the motor having an output shaft, the wheel being mounted onto the output shaft.

13. The apparatus of claim 12 wherein the assembly for rotatably driving the wheel comprises a motor, a gearbox driven by the motor for driving the wheel and an assembly measuring reaction torque provided by the motor.

14. The apparatus of claim 13 wherein the reaction torque measuring assembly comprises a first support, a second support movably mounted on the first support, the motor and gearbox being carried by the second support and a load sensor acting between the first and second supports for measuring the reaction force between the first and second supports.

15. The apparatus of claim 10 further comprising an assembly for measuring rotation of the wheel and thereby measuring the amount of spooled tubing run into the well.

16. The apparatus of claim 10 further comprising a mast for elevating the frictional gripping assembly above a well and an assembly mounting the frictionally gripping assembly comprising a frame and an assembly mounting the wheel on the frame for horizontal adjusting movement relative to the mast.

17. The apparatus of claim 16 further comprising an assembly mounting the mast for pivotal movement about a horizontal axis.

18. Apparatus for running spooled tubing into a well, comprising an assembly for receiving at least one spool having thereon a string of spooled tubing;

an injector assembly for frictionally gripping the spooled tubing string and propelling the same downwardly toward the well including a wheel having a circumferential groove for receiving the spooled tubing string;

an assembly extending at least partially around the circumferential groove for applying force to the tubing string and maintaining the tubing string in the groove;

an assembly for tensioning the force applying assembly; and an assembly for rotatably driving the wheel in a tubing advancing direction whereby rotation of the wheel propels the spooled tubing string toward the well including a motor, a gearbox driven by the motor and having an output shaft, the wheel being mounted on the output shaft.

19. The apparatus of claim 18 wherein the motor includes an output shaft concentric with the gearbox output shaft.

20. The apparatus of claim 18 further comprising an assembly for measuring pull in the tubing string.

21. The apparatus of claim 18 further comprising an assembly for measuring rotation of the wheel and thereby measuring the amount of spooled tubing run into the well.

22. The apparatus of claim 18 wherein the output shaft is cantilevered from the gearbox and the wheel is mounted on the end of the cantilevered shaft so the wheel can be easily removed and replaced.

23. The apparatus of claim 18 wherein the injector assembly comprises a frame and further comprising an assembly for elevating the injector assembly above a well including a mast having a length dimension and further comprising an assembly for moving the frame along the mast parallel to the length dimension.

24. The apparatus of claim 18 wherein the injector assembly comprises a frame and further comprising an assembly for elevating the injector assembly above a well including a mast having a length dimension and a width dimension transverse to the length dimension and further comprising an assembly for moving the wheel parallel to the width dimension.

25. Apparatus for running spooled tubing into a well, comprising an assembly for receiving at least one reel having thereon a string of spooled tubing;

an injector assembly for frictionally gripping the spooled tubing string and propelling the same downwardly toward the well including a frame having a wheel thereon providing a circumferential groove for receiving the spooled tubing string, the wheel being mounted on the frame for horizontal adjusting movement; and an assembly for rotatably driving the wheel in a tubing advancing direction whereby rotation of the wheel propels the spooled tubing string toward the well.

26. Apparatus for running spooled tubing into a well, comprising an assembly for receiving at least one reel having thereon a string of spooled tubing; and an assembly for frictionally gripping the spooled tubing string and propelling the same downwardly toward the well including a wheel having at least two circumferential grooves of different size for receiving spooled tubing strings of different size and an assembly for rotatably driving the wheel in a tubing advancing direction whereby rotation of the wheel propels a spooled tubing string toward the well.

* * * * *